US005299932A

United States Patent [19]

Piver

[11] Patent Number: 5,299,932

[45] Date of Patent: Apr. 5, 1994

[54] FUEL AND AIR SUPPLY CONTROL APPARATUS FOR GAS BURNERS

[76] Inventor: F. James Piver, 26608 188th Ave. SE., Kent, Wash. 98042

[21] Appl. No.: 980,703

[22] Filed: Nov. 24, 1992

[51] Int. Cl.[5] ..... F23D 14/62

[52] U.S. Cl. ..... 431/354; 126/39 N; 126/39 R; 137/607

[58] Field of Search ..... 431/354; 126/39 N, 39 R; 137/607

[56] References Cited

U.S. PATENT DOCUMENTS

| | | | |
|---|---|---|---|
| 1,977,552 | 10/1934 | Grayson et al. | 126/39 N |
| 2,456,864 | 12/1948 | Cole | 126/39 N X |
| 4,465,456 | 8/1984 | Hynek et al. | 431/354 X |
| 4,640,678 | 2/1987 | Fraioli | 431/354 |
| 5,097,818 | 3/1992 | Kee et al. | 126/39 N X |

*Primary Examiner*—Larry Jones
*Attorney, Agent, or Firm*—Robert W. Jenny

[57] ABSTRACT

The fuel and air supply apparatus provides a fuel/air mixture for gas burners. The ratio of fuel to air in the mixture is adjustable and remains constant at any setting in spite of changes in air flow rate made to adjust the flame size and height. The fuel/air mixture is supplied to the burner through a venturi which, in turn, is supplied with fuel and air. The venturi is such that the amount of gas entrained into and mixed with the air is directly proportional to the air flow velocity into the venturi. Such a venturi is available form the J & P Machine and Tool Co., 22 Delawanna Avenue, Clifton, N.J. 07014. The fuel is supplied to the venturi through a zero regulator which supplies fuel in direct proportion to the demand. The combined functions of the venturi and regulator provide the fuel/air mixture as described. A suitable zero regulator is available from Maxitrol, 23555 Telegraph, Southfield, Mich. 48037, Model No. R400SZ. Fuel/air mixture may be provided to one or more than one burner from one fuel supply and control apparatus. Commercially available valves are used to control air flow and to control fuel flow into the venturi to adjust the mixture ratio.

1 Claim, 2 Drawing Sheets

FUEL AND AIR SUPPLY CONTROL APPARATUS FOR GAS BURNERS

BACKGROUND OF THE INVENTION

1. Field

The subject invention is in the field of gas fired burners such as Bunsen burners. More specifically it is in the field of such burners adapted to heating glass for the purposes of bending and otherwise forming the glass. Still more specifically, it is in the field of such burners used in the forming of glass tubing used in luminous tubing signs commonly known as neon signs.

2. Prior Art

There is no patented prior art to the subject apparatus known to the inventor. Prior art conventional apparatus is made from commercially available components, tubing and other materials and hardware. A commercially available or specially built burner is supplied with a mixture of gaseous fuel (fuel) and air. The air/fuel mixture must be precisely controlled in terms of mixture pressure, fuel/air ratio and flame size, flame size being related to the size of the glass material being worked. All three variables are controlled by adjustment of the mixture pressure and fuel/air ratio and adjustment of any one variable requires careful and precise adjustment of the other two, using valves and pressure regulators to control the flows of air and fuel. In working glass tubing for signs it is necessary to adjust flame size (particularly length) frequently and much time and special skill is required to make the flame size and related adjustments accurately and expediently. Accordingly, the prime objective of the subject invention is to provide apparatus of the subject type which requires considerably less time and skill to use relative to the quantity and quality of work produced. Other objectives are that the apparatus be simple to build and be made from commercially available components.

SUMMARY OF THE INVENTION

The subject invention is apparatus for providing and controlling the gaseous fuel/air mixture to a burner used for working the glass tubing used in neon signs. The air is provided by a motor driven blower, providing air at high volume and low pressure relative to the volume/pressure ratio used in conventional apparatus of the subject type. The gaseous fuel (gas) is supplied from a storage tank or gas utility system through a flow regulator which is a key component of the subject invention. The gas and air are mixed in a venturi valve in which air flow through the venturi draws in gas in quantity directly proportional to the air flow quantity (cubic feet per minute). A suitable venturi mixer (termed a venturi) is marketed by J & P Machine and Tool Co., 22 Delawanna Avenue, Clifton, N.J. 07014. Air flow quantity is adjusted by a valve in the air supply line to the mixer/venturi. Gas flow into the venturi is also adjustable by a valve in the gas supply line. The fuel/air mixer output is fed into a burner.

The quantity of fuel gas flow into the venturi is regulated primarily by the pressure regulator which is termed an atmospheric governor or zero regulator. This kind of regulator is commercially available, one example being the Maxitrol (T.M.) Model No. R400SZ, marketed by Maxitrol, 23555 Telegraph, Southfield, Mich. 48037. A zero regulator supplies gas only on demand and in direct proportion to the demand. The demand is provided by the venturi which, as stated above, demands fuel in direct proportion to the flow velocity through the venturi. These two facts result in a third: the fuel to air ratio of the mixture of gas and air emitted from the venturi is essentially and effectively constant independent of output flow velocity. This third fact enables the subject invention to achieve its prime objective of significantly reducing the time and skill required relative to the quantity and quality of work done in forming glass tubing for neon signs.

The invention is described in more detail below with references to the attached drawings.

DETAILED DESCRIPTION OF THE INVENTION

Figure 1:
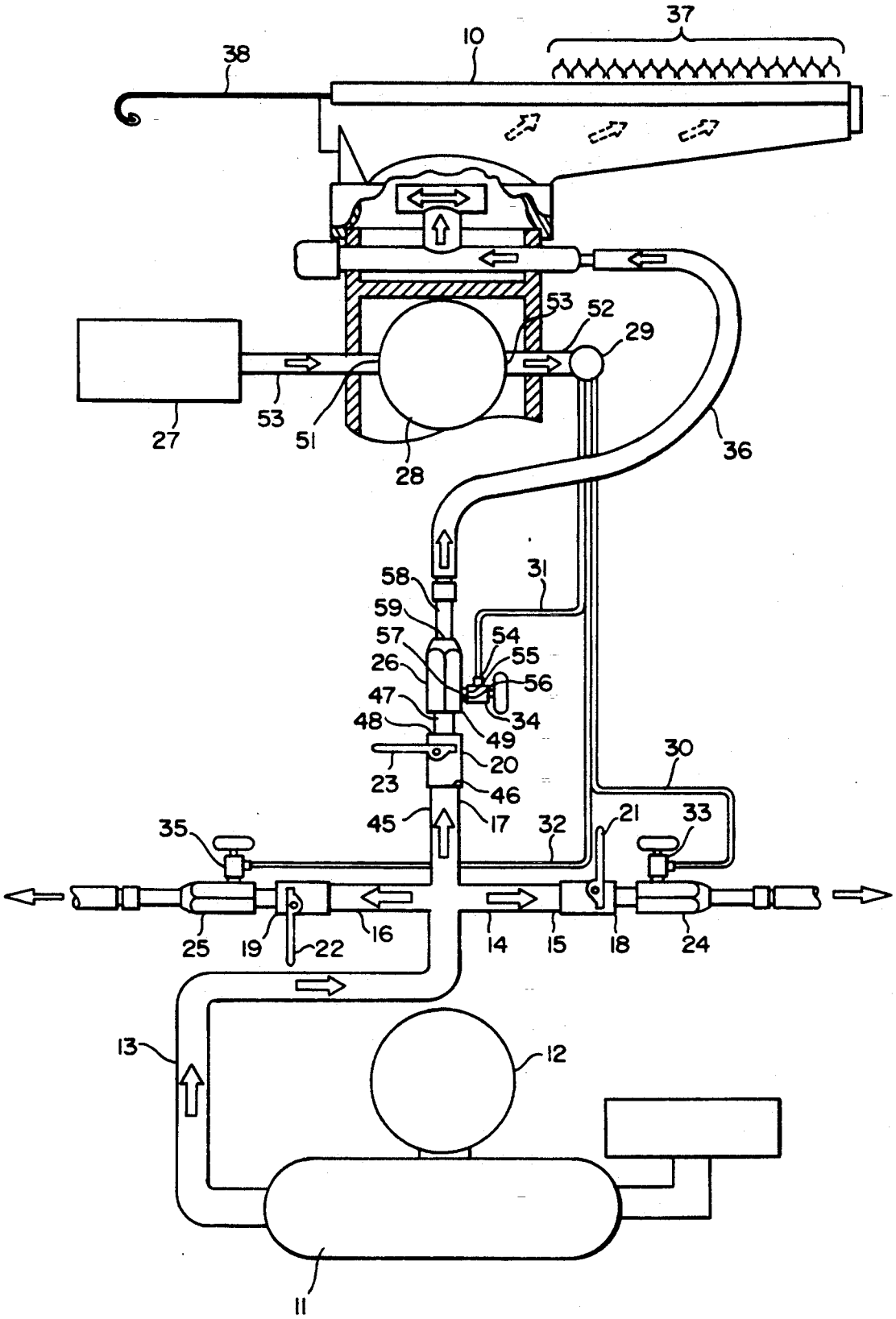
FIG. 1 is a schematic representation of the subject apparatus.

The subject invention is gas burner apparatus useful in manufacturing neon signs. FIG. 1 is a sectional schematic of a preferred embodiment of the apparatus. The illustrated apparatus is arranged to serve three burners with one burner 10 shown. The burner burns a mixture of gaseous fuel, termed fuel for purposes of this disclosure, and air. The air is supplied by a blower 11 driven by motor 12 through tube 13 and manifold 14. Outlets 15, 16 and 17 of the manifold are fitted with flow control valves 18, 19 and 20 respectively. Handles 21, 22 and 23 are used to adjust the flow rate of air through valves 18, 19 and 20 respectively. The outflow from the control valves is fed into venturis 24, 25 and 26 respectively. The venturi is explained in more detail below.

Fuel is supplied from a pressurized tank 27 (or a gas utility system outlet) to a regulator 28 which supplies fuel at its outlet 29 at flow rates corresponding directly to the level of suction (negative pressure) present at the outlet. This kind of regulator is termed an atmospheric governor or zero regulator and is available from Maxitrol (T.M.), 23555 Telegraph, Southfield, Mich. 48037. Their valve model number R400SZ, is suited to the purposes of the subject invention. Suction is applied at the outlet from tubes 30, 31 and 32 connected to mixture ratio control valves 33, 34 and 35 respectively. Suction is generated at each valve by the venturi the valve is attached to, as described below. Venturis of the required type are available from the J & P Machine and Tool Co, 22 Delawanna Avenue, Clifton, N.J. 07014. The flow rate of fuel delivered into the venturi varies directly in proportion to the rate of air flow through the venturi and range of flow rate of fuel is adjusted by the valve at each venturi.

The fuel/air mixture is delivered to burner 10 through tube 36. The burner is commercially available. The length of flame 37 is adjustable by moving blade 38 into or out of the burner. Almost every time the flame length is adjusted the flow rate of the air/fuel mixture must be adjusted and the mixture ratio must be kept within close tolerances.

Figure 2:
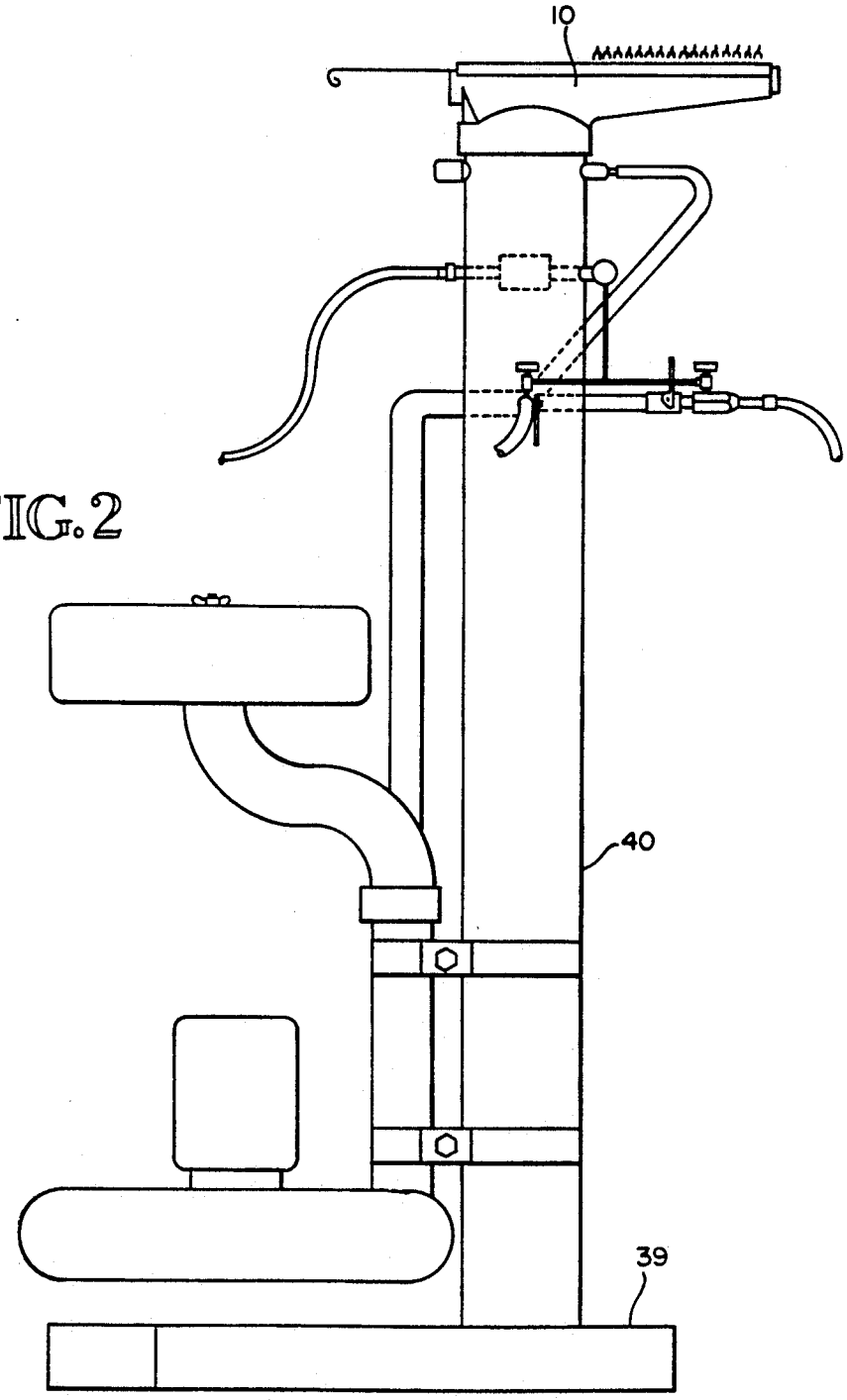
FIG. 2 is an elevation view of one embodiment of the subject apparatus.

FIG. 2 is an elevation view of a burner apparatus incorporating the subject invention. Component numbering corresponds to the numbering in FIG. 1. The burner 10 is supported from base 39 by column 40

Figure 3:
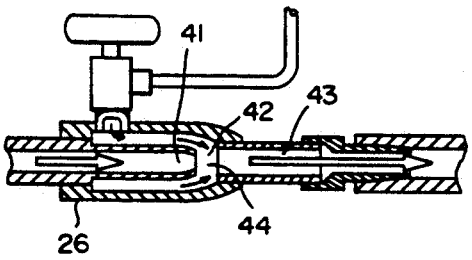
FIG. 3 is a sectional schematic of the venturi valve used in the subject apparatus.

FIG. 3 is a sectional view of venturi 26 taken in the plane in which the longitudinal axes of the venturi and the mixture control valve 34 lie. Air flowing from nozzle 41 and across gap 42 into outlet tube 43 entrains fuel entering chamber 44 from the mixture ratio control valve and the mixture flows into the burner.

In use of the subject apparatus, once the fuel/air (mixture) ratio has been adjusted it is not necessary to readjust it each time air flow rate is adjusted to accommodate flame length and adjust flame height. This is possible because the fuel entrained in the venturi is directly proportional to air/flow and the regulator releases fuel in direct response to demand.

The apparatus depicted in FIGS. 1 and 2 is such that more than one burner can be supplied with air and fuel from single sources of air and fuel. When more than one burner is used, flame adjustment of one burner affects the other(s). In conventional burner apparatus this situation requires resetting both the flow and mixture in all burners fed by single sources of air and fuel. This is further complicated by the fact that the air flow rate and fuel flow rate are interdependent. As a result considerable time is required to reset apparatus each time one burner is adjusted. This complication is significantly reduced by the automatic regulation of air/fuel mixture in the subject apparatus. Each time flame length is adjusted the only related adjustments is of the air flow rate valve feeding each burner to adjust flame height.

Referring again to FIG. 1, the various components of the apparatus are interconnected by passages: tubes, pipes, passages integral to a component and the like: one passage 45 from the air supply to input port 46 of the air flow rate control valve; a second 47 from the outlet port 48 of the airflow rate control valve to the air input port 49 of the venturi; a third 50 from the fuel supply to the inlet port 51 of the zero regulator; a fourth 52 from the outlet port 53 of the zero regulator to the inlet port 54 of the fuel flow rate control valve; a fifth 55 from the outlet port 56 of the fuel flow control valve to the fuel inlet port 57 on the venturi and a sixth 58 from the outlet port 59 of the venturi to the burner.

It is considered to be understandable from this description that the subject invention meets its objectives. It provides glass working burner apparatus which requires considerably less time and skill to use relative to the quality and quantity of work produced. Further, the apparatus is simple to build and made from commercially available functional and structural components.

It is also considered to be understandable that while one embodiment of the invention is described herein, other embodiments and modifications of the one described are possible within the scope of the invention which is limited only by the attached claims.

I claim:

1. Apparatus for controlling the flow rates and mixing of air and gaseous fuel supplied to a gas burner from an air source and a gaseous fuel source, said apparatus comprising:

an air flow rate control valve having a first air input port and a first air output port, a venturi having a second air input port, a first fuel input port and a fuel/air mixture output port, a fuel flow rate control valve having a second fuel input port and a first fuel output port, a zero regulator having a third fuel input port and a second fuel output port, a first passage connecting said first air input port to said air supply, a second passage connecting said first air output port to said second air input port, a third passage connecting said third fuel input port to said fuel supply, a fourth passage connecting said second fuel output port to said second fuel input port, a fifth passage connecting said first fuel output port to said first fuel input port, and a sixth passage from said fuel/air mixture output port to said burner, whereby, with characteristics of said zero regulator being delivery of output only on demand and in direct proportion to the amount of demand and with a characteristic of said venturi being induction of fuel in direct proportion to the rate of flow through it, the ratio of fuel to air in the outflow from said venturi is adjustable by adjustment of said fuel flow rate control valve and is constant independent of air flow rate as adjusted by said airflow rate control valve.

* * * * *